US010428616B2

(12) United States Patent
Dirocco

(10) Patent No.: US 10,428,616 B2
(45) Date of Patent: Oct. 1, 2019

(54) FRAC PLUG HAVING REDUCED LENGTH AND REDUCED SETTING FORCE

(71) Applicant: FORUM US, INC., Houston, TX (US)

(72) Inventor: Robert Dirocco, Humble, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 15/823,320

(22) Filed: Nov. 27, 2017

(65) Prior Publication Data

US 2019/0162044 A1 May 30, 2019

(51) Int. Cl.

| | |
|---|---|
| ***E21B 33/128*** | (2006.01) |
| ***E21B 34/14*** | (2006.01) |
| ***E21B 33/129*** | (2006.01) |
| *E21B 43/26* | (2006.01) |

(52) U.S. Cl.

CPC ..... *E21B 33/128* (2013.01); *E21B 33/1294* (2013.01); *E21B 34/14* (2013.01); *E21B 43/26* (2013.01)

(58) Field of Classification Search

CPC ..... E21B 33/128
USPC ..... 166/193
See application file for complete search history.

(56) References Cited

U.S. PATENT DOCUMENTS

| | | | |
|---|---|---|---|
| 2,230,712 | A | 2/1941 | Bendeler et al. |
| 3,343,607 | A | 9/1967 | Current |
| 4,436,150 | A | 3/1984 | Barker |
| 6,167,963 | B1 | 1/2001 | McMahan et al. |
| 6,491,116 | B2 | 12/2002 | Berscheidt et al. |
| 7,735,549 | B1 | 6/2010 | Nish et al. |
| 7,740,079 | B2 | 6/2010 | Clayton et al. |
| 8,079,413 | B2 | 12/2011 | Frazier |
| 9,169,704 | B2 | 10/2015 | Dockweiler et al. |
| 9,759,034 | B2 | 9/2017 | King et al. |
| 9,777,551 | B2 | 10/2017 | Davies et al. |
| 9,835,003 | B2 | 12/2017 | Harris et al. |
| 2011/0240295 | A1 | 10/2011 | Porter et al. |
| 2015/0013965 | A1 | 1/2015 | Cox et al. |
| 2015/0101797 | A1* | 4/2015 | Davies ..... E21B 33/1208 166/193 |
| 2015/0129242 | A1* | 5/2015 | Farquhar ..... E21B 23/06 166/387 |
| 2015/0300121 | A1* | 10/2015 | Xu ..... E21B 33/1208 166/118 |
| 2016/0138387 | A1 | 5/2016 | Xu et al. |

(Continued)

FOREIGN PATENT DOCUMENTS

| | | | |
|---|---|---|---|
| WO | 2016044597 | A1 | 3/2016 |
| WO | 2016210161 | A1 | 12/2016 |
| WO | 2017044298 | A1 | 3/2017 |

OTHER PUBLICATIONS

PCT International Search Report/Written Opinion dated Feb. 26, 2019 for Application No. PCT/US2018/060803.

*Primary Examiner* — Taras P Bemko
(74) *Attorney, Agent, or Firm* — Patterson & Sheridan, L.L.P.

(57) ABSTRACT

A frac plug having a mandrel body, a cap coupled to an upper end of the mandrel body and an outer housing coupled to a lower end of the mandrel body. A guide shoe is coupled to the outer housing. A single slip assembly is positioned between the cap and the guide shoe and surrounds the mandrel body. A sealing element is positioned between the cap and the single slip assembly and surrounds the mandrel body.

20 Claims, 6 Drawing Sheets

(56) References Cited

U.S. PATENT DOCUMENTS

2016/0305215 A1 10/2016 Harris et al.
2016/0312555 A1* 10/2016 Xu ..... E21B 23/01

* cited by examiner

FRAC PLUG HAVING REDUCED LENGTH AND REDUCED SETTING FORCE

BACKGROUND

Field

Embodiments disclosed herein relate to non-retrievable plugs that may be used to isolate a portion of a well in the production of oil and gas.

Description of the Related Art

Fracturing plugs or "frac plugs" are designed to set, seal, and isolate inside of a wellbore casing to divide the well into one or more zones. After the frac plug is set, it acts as a one way valve that allows fluid flow in one direction and not the other. This allows the casing to hold tremendous pressure above the frac plug, but when the pressure is released, the well returns to equilibrium. The casing is then perforated in one of the zones, and the formation surrounding the perforation is fractured using hydraulic pressure that is supplied through the casing to stimulate the formation. After the pressure is released and the stimulation is complete, the perforations in the casing and fractures in the formation allow the flow of oil and gas to enter the annulus of the casing and be recovered to the surface. After the fracturing and stimulation operation is complete, the frac plug is drilled out to allow access to the full bore of the casing for subsequent operations.

Frac plugs create a seal inside of the wellbore casing by axially squeezing an "element package" having a seal element located between two members on a body of the frac plug. One drawback of conventional frac plugs is that they require a large axial setting force to "squeeze" the element package, which results in the seal element projecting radially outside the outside diameter of the frac plug to contact the casing. Another drawback is that conventional frac plugs have long axial lengths, which increases the amount of drilling that is needed to drill out the frac plugs to have access to the full bore of the casing as described above.

Therefore, there exists a need for new and/or improved frac plugs.

SUMMARY

Embodiments disclosed herein relate to non-retrievable frac plugs that may be used to isolate a portion of a well in the production of oil and gas.

In one embodiment, a frac plug is disclosed which includes a mandrel body, a cap coupled to an upper end of the mandrel body, wherein the cap has an angled surface, an outer housing coupled to a lower end of the mandrel body, a guide shoe coupled to the outer housing, a single slip assembly positioned between the cap and the guide shoe and surrounding the mandrel body, and a sealing element positioned between the cap and the single slip assembly and surrounding the mandrel body. The sealing element is movable along the angled surface to force the sealing element radially outward into contact with a surrounding wellbore.

In one embodiment, a frac plug is disclosed which includes a mandrel body, a cap coupled to an upper end of the mandrel body, an outer housing coupled to a lower end of the mandrel body, a guide shoe coupled to the outer housing, a single slip assembly positioned between the cap and the guide shoe and surrounding the mandrel body, and a sealing element positioned between the cap and the single slip assembly and surrounding the mandrel body. The length of the frac plug when in a set position is shorter than the length of the frac plug when in an unset position.

BRIEF DESCRIPTION OF THE DRAWINGS

FIG. 5A shows the frac plug in an unset position while FIG. 5B shows the frac plug in a set position.

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments disclosed herein relate to non-retrievable fracturing plugs or "frac plugs" that may be used to isolate a portion of a well in the production of oil and gas. Conventional frac plugs require a large axial setting force to be set and are relatively long in length. Embodiments of the frac plug disclosed herein require a setting force that is about 90% less than the setting force of conventional frac plugs. Embodiments of the frac plug disclosed herein are shorter in length than conventional frac plugs, which reduces the amount of time needed to drill out the frac plug from a well.

Figure 1:
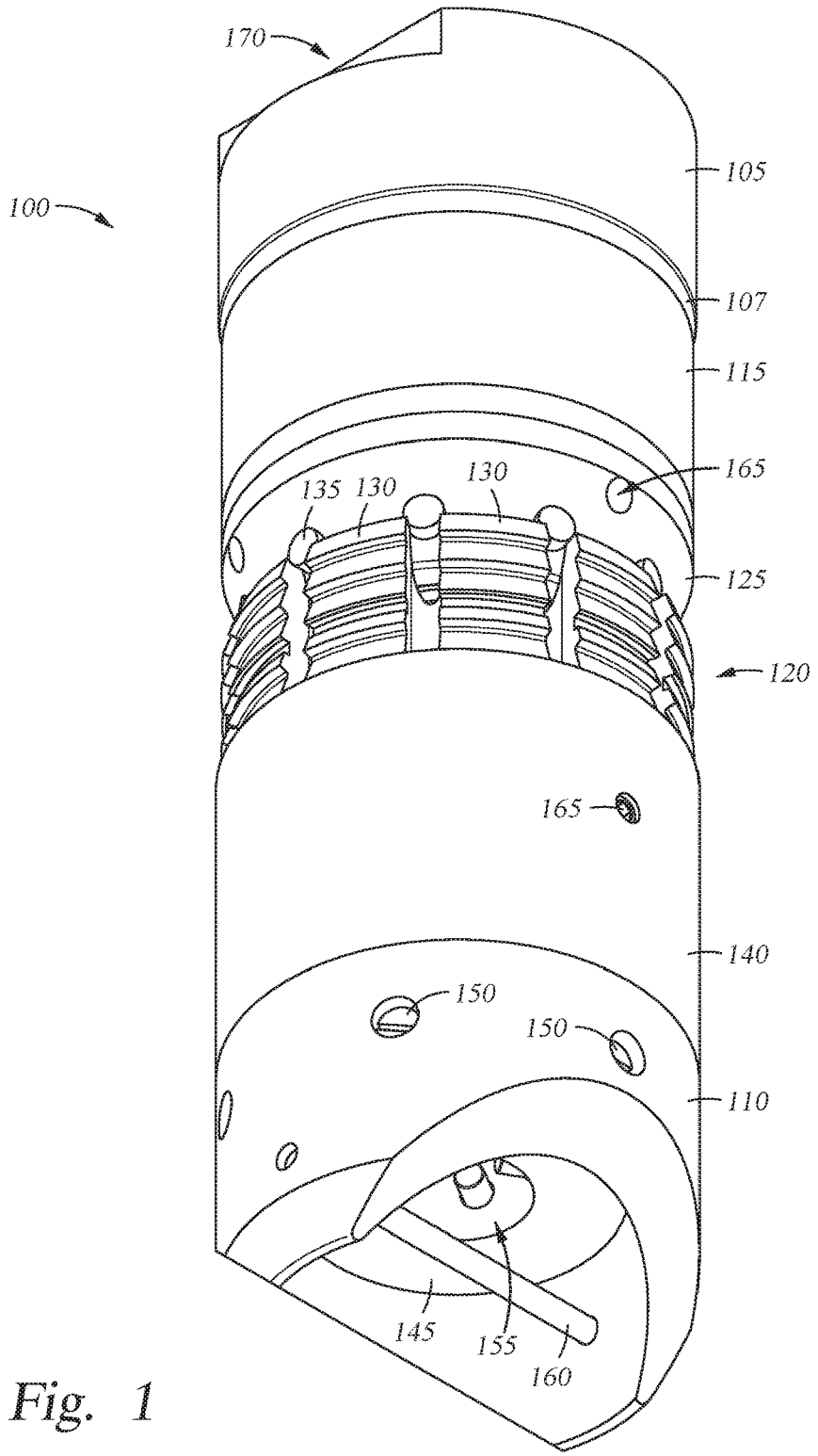
FIG. 1 is an isometric bottom view of a frac-plug according to one embodiment.
Figure 2:
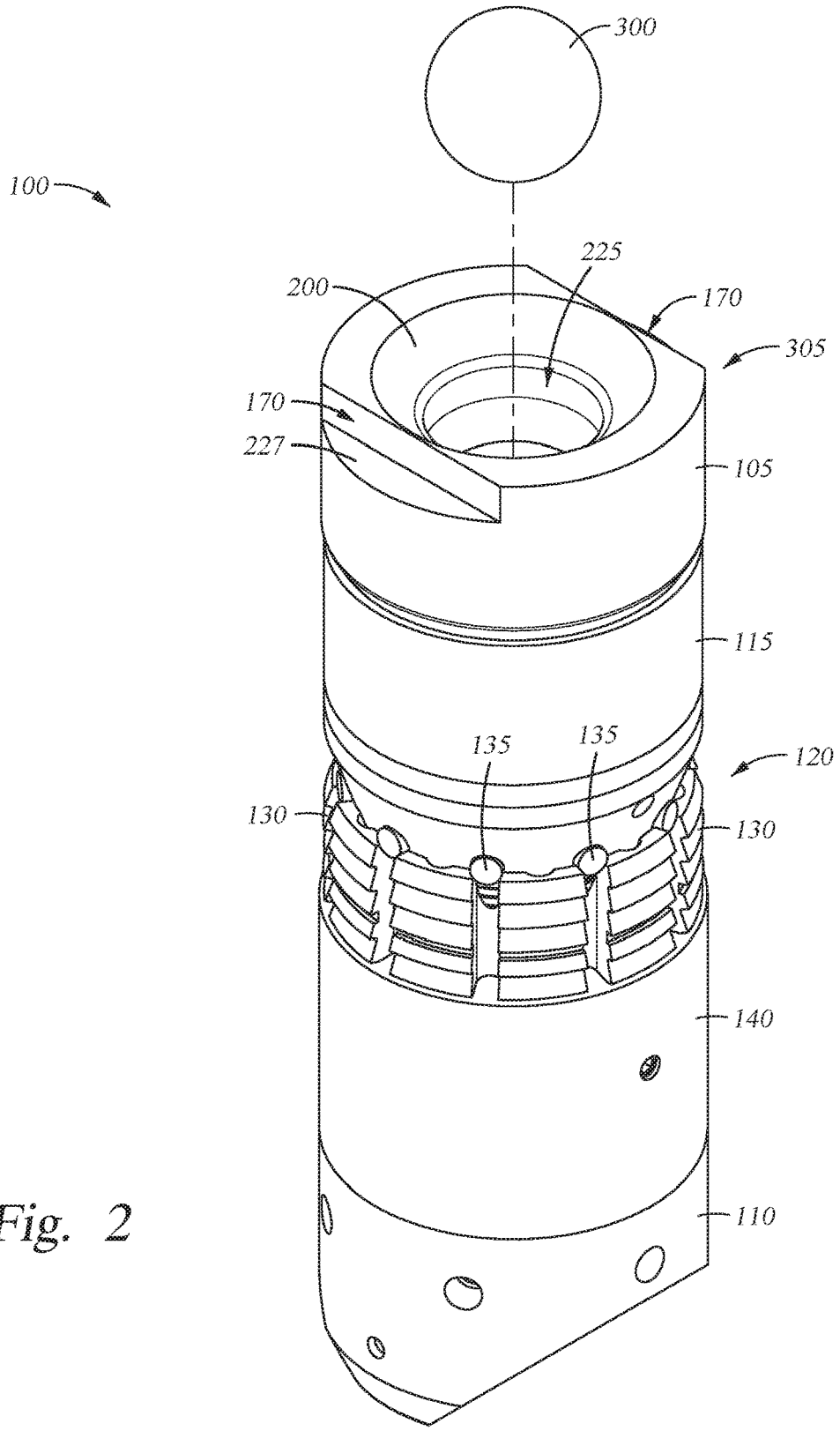
FIG. 2 is an isometric top view of the frac-plug of FIG. 1.
Figure 3:
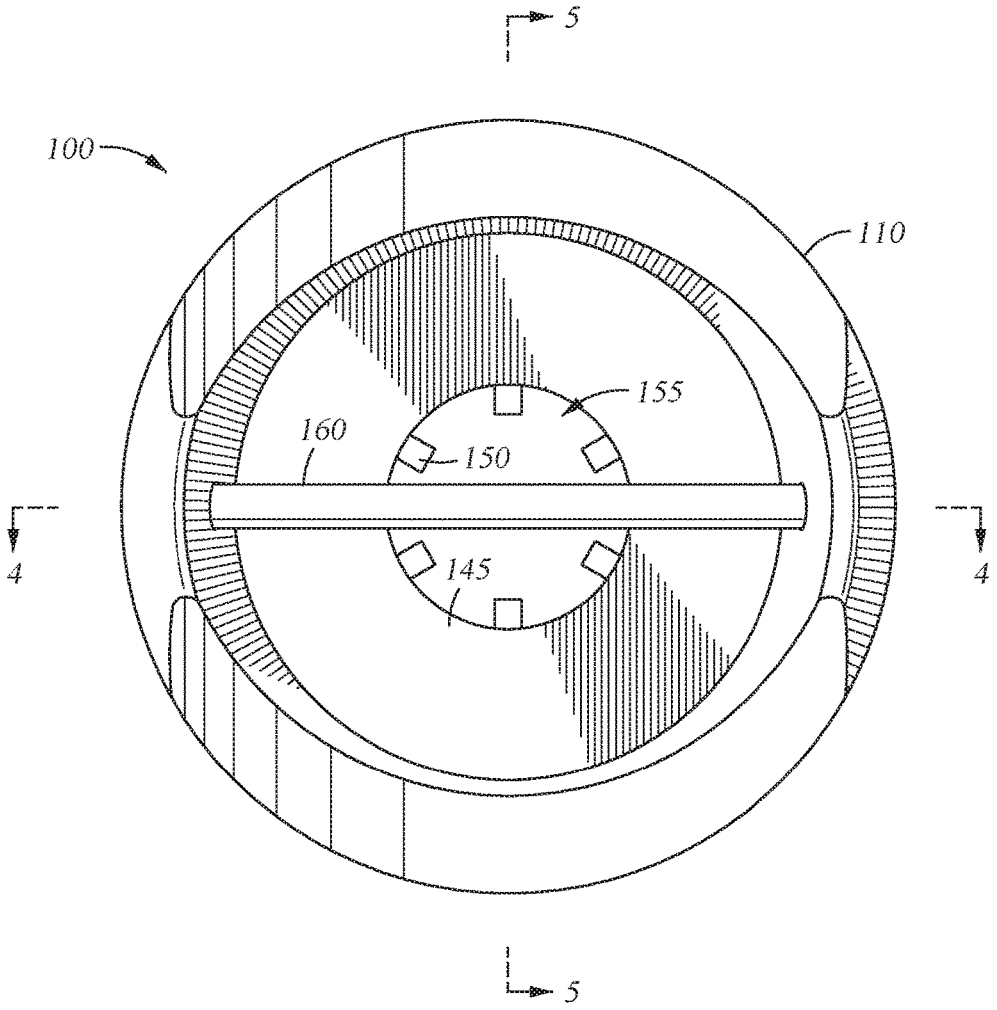
FIG. 3 is a bottom view of the frac-plug of FIG. 1.
Figure 4:
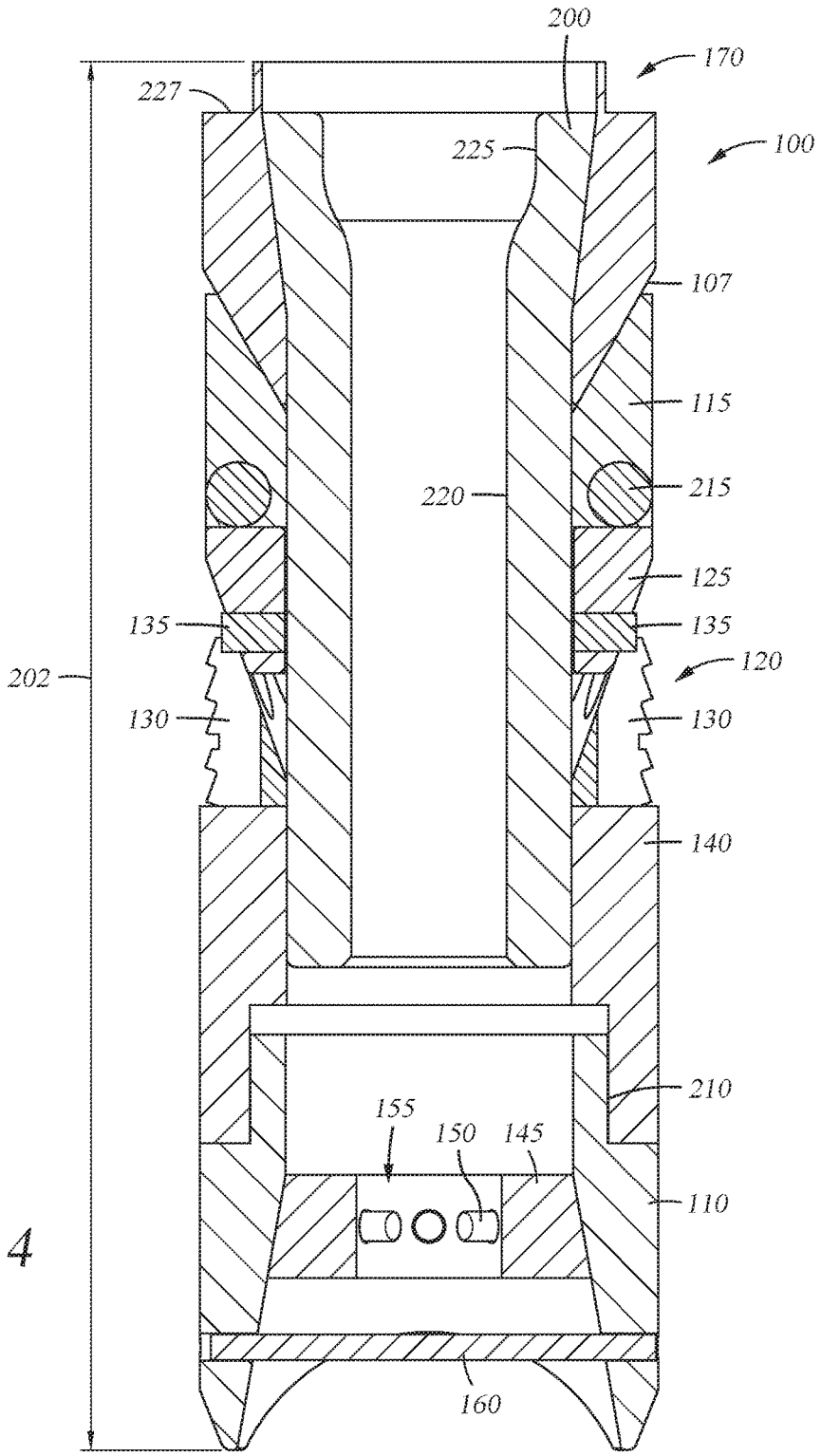
FIG. 4 is a side view of the frac-plug along lines 4-4 of FIG. 3.

FIG. 1 is an isometric bottom view of a frac-plug 100 according to one embodiment. FIG. 2 is an isometric top view of the frac-plug 100. FIG. 3 is a bottom view of the frac-plug 100. FIG. 4 is a side view of the frac-plug 100 along lines 4-4 of FIG. 3.

The frac-plug 100 includes a mandrel body 200 coupled to a guide shoe 110. A cap 105, having a lower angled surface 107, is disposed about an outer surface of the mandrel body 200. The cap 105 includes a shoulder 170 on opposing sides thereof. The shoulders 170 may include a flat 227 (shown in FIG. 2) milled in or on opposing sides thereof. The flats 227 of the shoulders 170 are configured as a contact point for an outer mandrel of a setting tool. An upper portion of the cap 105 is configured as a setting tool interface for the frac-plug 100.

The mandrel body 200 includes an inner diameter 220 forming a flow bore through which fluid can flow through when the frac-plug is in an unset position and a set position as further described below. The mandrel body 200 also includes a ball seat 225 sized to receive a ball 300 (shown in FIG. 2), which may be made from a composite material and dropped onto the ball seat 225 to prevent fluid from flowing through the flow bore of the mandrel body 200. The inner diameter 220 allows fluid to flow through the frac-plug 100 when the ball 300 is not seated in the ball seat 225. The inner diameter 220 is sized to receive an inner mandrel of a setting tool as shown and described in more detail in FIGS. 5A and 5B.

A sealing element 115 and a single slip assembly 120 are also disposed about the outer surface of the mandrel body 200. The frac-plug 100 has a length 202 (shown in FIG. 4)

that is less than conventional frac plugs, which often include two sets of slip assemblies. Additionally, the number of parts in the frac-plug 100 is less than conventional frac plugs, which reduces manufacture time and costs.

The sealing element 115 is disposed between cap 105 and the single slip assembly 120. The sealing element 115 includes a biasing member 215 (shown in FIG. 4) disposed within the sealing element 115 material. The biasing member 215 is a metallic member that biases the sealing element 115 radially inward toward the outer surface of the mandrel body 200. The biasing member 215 may be a spring or spring-like element that surrounds the mandrel body 200.

The single slip assembly 120 includes a cone 125, slips 130, and pins 135 disposed about the outer surface of the mandrel body 200. The pins 135 are positioned at least partially between the slips 130. The pins 135 also are disposed at least partially through the cone 125. The slips 130 are positioned above an outer housing 140. A lower portion of the outer housing 140 is received in a reduced diameter shoulder 210 (shown in FIG. 4) of an upper portion of the guide shoe 110.

Figure 5A:
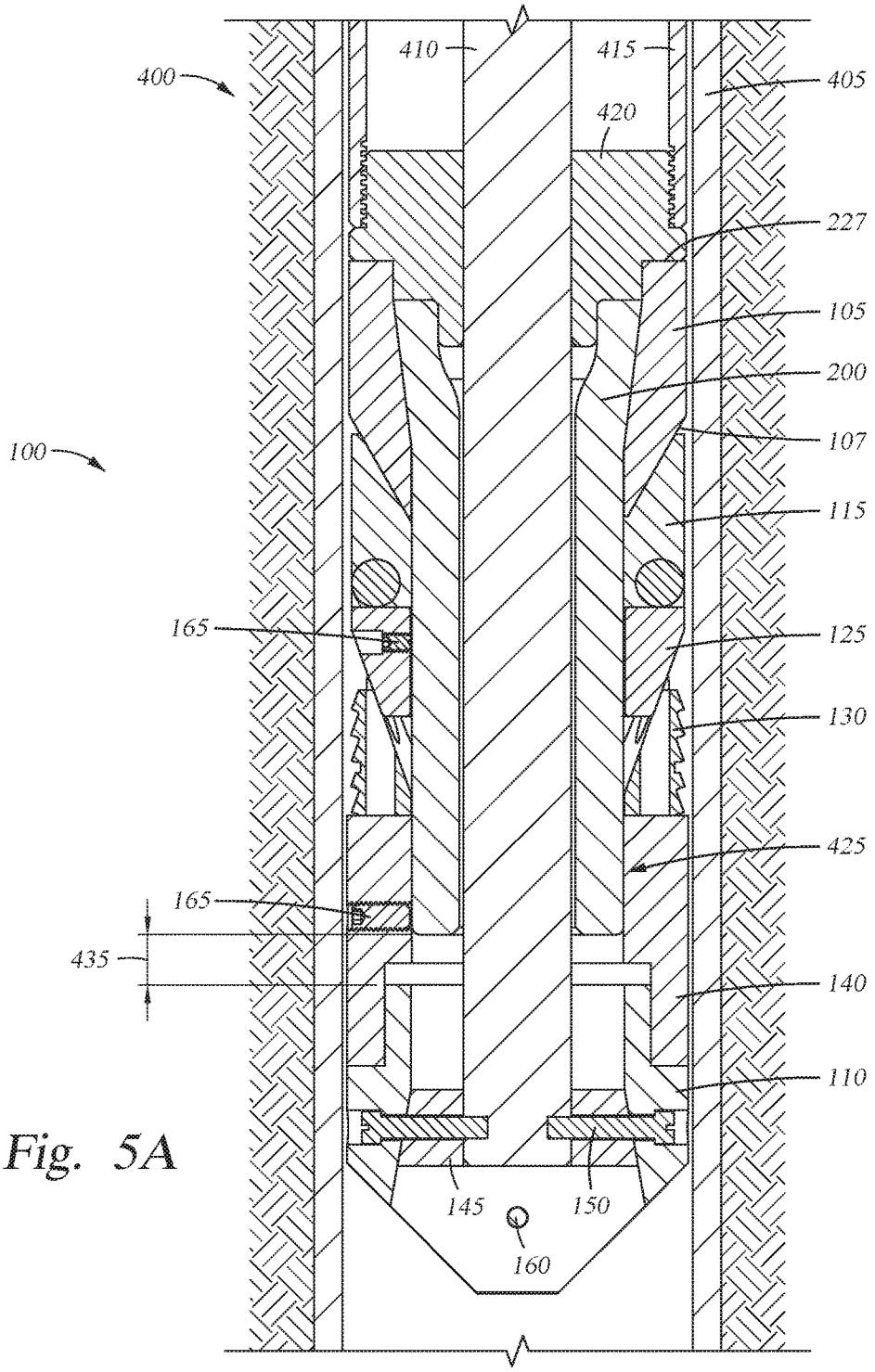
FIGS. 5A and 5B are sectional views of the frac-plug along lines 5-5 of FIG. 3 illustrating a setting procedure according to one embodiment.
Figure 5B:
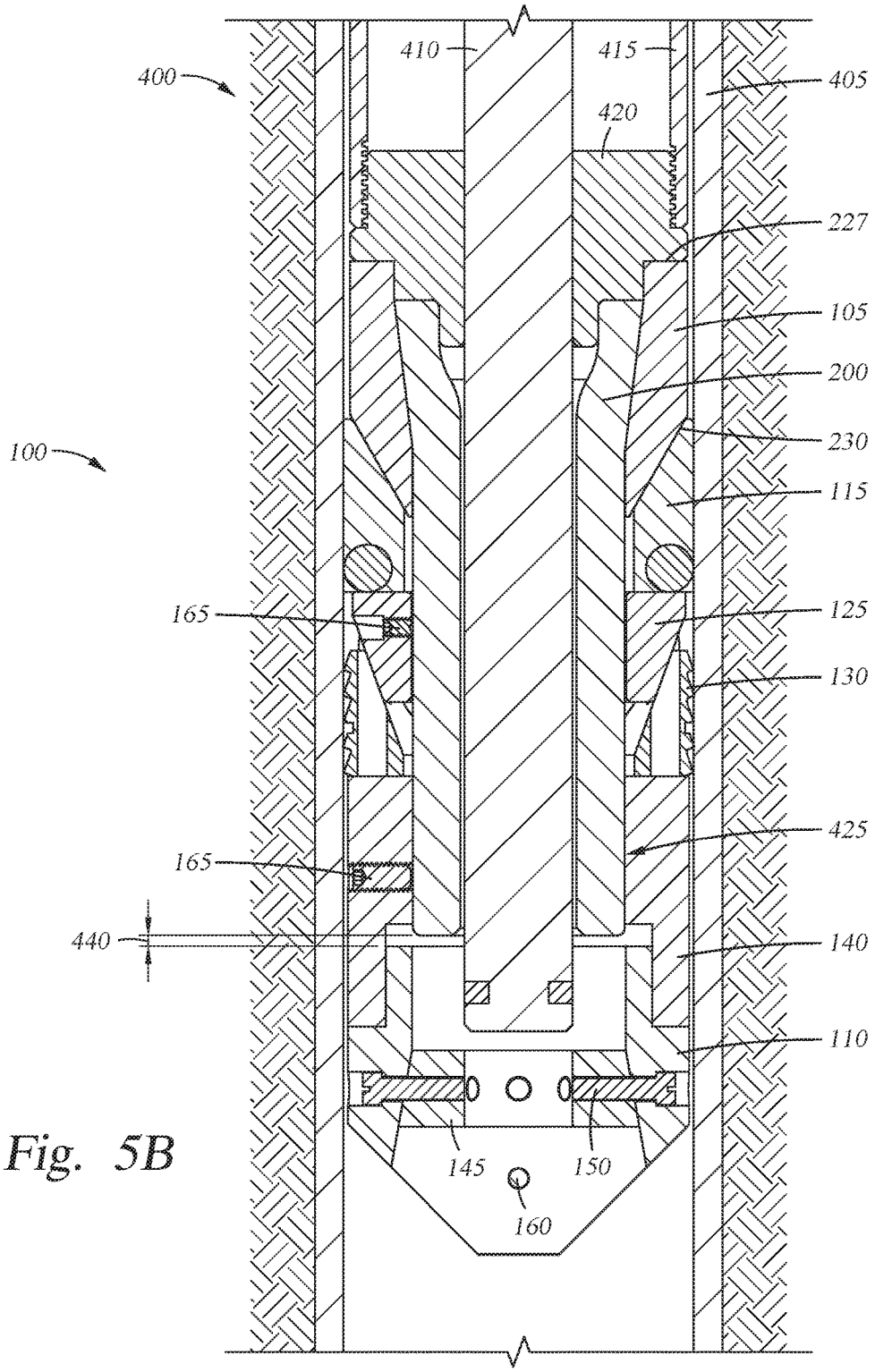

A shear cap 145 is positioned in an inner region of the guide shoe 110. The shear cap 145 is held in place by a plurality of shear pins 150 (shown in FIGS. 3 and 4) that are disposed through the guide shoe 110. The shear cap 145 includes a central opening 155 sized to receive an inner mandrel of a setting tool as shown and described in more detail in FIGS. 5A and 5B. When setting the frac-plug 100, the shear pins 150 are sheared after the frac-plug 100 is set which may free the shear cap 145. The shear cap 145 is maintained within the frac-plug 100 by a pin 160 coupled to a bottom portion of the guide shoe 110. As shown in FIGS. 5A and 5B, one or more set screws 165 may be used to secure the cone 125 to the mandrel body 200, as well as to secure the outer housing 140 to the mandrel body 200. The pin 160 may be utilized to prevent a ball from seating in the guide shoe 110 (thereby preventing the frac-plug 100 from becoming a bridge plug).

The frac-plug 100 is made from drillable materials such as composite materials, plastics, rubbers, and fiberglass, as well as cast iron, brass, and fiberglass. Composite material may include a carbon fiber reinforced material or other material that has high strength yet is easily drillable. The mandrel body 200, the cap 105, the cone 125, the outer housing 140, the guide shoe 110, and the shear cap 145 may be made of a composite material. The slips 130 may be made of cast iron. The biasing member 215 may be made of light gauge spring steel that is easily drilled. The shear pins 150 may be made of carbon steel. The set screws 165 may be made of brass. The pin 160 and the pins 135 may be made of fiberglass.

The sealing element 115 may be made of a rubber that can withstand high temperatures, such as hydrogenated nitrile butadiene rubber (HNBR), or other suitable polymeric material. In one embodiment, the sealing element 115 has a hardness of about 80 on the Shore D scale, and withstands temperatures of about 300 degrees Fahrenheit.

FIGS. 5A and 5B are side, sectional views of the frac-plug 100 along lines 5-5 of FIG. 3 illustrating a setting procedure. The frac-plug 100 is shown positioned in a wellbore 400 in FIGS. 5A and 5B. FIG. 5A shows an unset position while FIG. 5B shows a set position. A wellbore 400 includes a casing 405 into which the frac-plug 100 is lowered and set to form a seal. A setting tool, only a portion of which is shown in FIGS. 5A and 5B, includes an inner mandrel 410, an outer mandrel 415, and an adapter 420 which is configured to engage the upper end and shoulder 170 of the cap 105, as well as the upper end of the mandrel body 200.

The inner mandrel 410 is disposed through the frac-plug 100 and is coupled to the guide shoe 110 and the shear cap 145 by the shear pins 150. An axial pull force, also referred to as a setting force, is applied by the inner mandrel 410 while the outer mandrel 415 and the adapter 420 remain static to set the frac-plug 100. The axial pull force applied by the inner mandrel 410 applies an upward force to the guide shoe 110 which is transmitted to the outer housing 140, the slips 130, the cone 125, and the sealing element 115.

The guide shoe 110, the outer housing 140, the slips 130, the cone 125, and the sealing element 115 all move upward together relative to the mandrel body 200 and the cap 105, which are held in place by the outer mandrel 415 and the adapter 420 of the setting tool. The sealing element 115 is moved upward along the angled surface 107 of the cap 105 and forced radially outward into contact with the inner surface of the casing 405 to form a seal with the casing 405. The cone 125 is at least partially held in place by the expanded sealing element 115 and such that the slips 130 move up along the cone 125, which causes the slips 130 to extend radially outward into contact with the inner diameter of the casing 405. The setting force applied to the frac-plug 100 is decreased by about 90% due to pulling the sealing element 115 up along the angled surface 107 to form the seal, when compared to the setting force required to set conventional frac plugs which require compressing or "squeezing" a sealing element between two bodies.

As shown in FIG. 5B, the frac-plug 100 is set within the casing 405, and the sealing element 115 forms a seal between the frac-plug 100 and the casing 405. The axial pull force is continued to be applied by the inner mandrel 410 until the shear pins 150 shear, as shown in FIG. 5B, which releases the inner mandrel 410 from the frac-plug 100. The setting tool can then be removed from the wellbore 400 and fluid can still flow through the frac-plug 100 when set. When needed, the ball 300 (shown in FIG. 2) can be dropped onto the ball seat 225 of the mandrel body 200 to close fluid flow through the frac-plug 100. Pressure within the casing 405 above the frac-plug 100 can be increased to conduct a fracturing and/or stimulation operation as known in the art.

The frac-plug 100 is held in the set position by a friction or interference-fit interface 425, which includes a surface to surface contact between an outer surface of the mandrel body 200 and an inner surface of the outer housing 140. The friction or interference-fit interface 425 may be used to allow movement in one direction and prevents or minimizes movement in the opposite direction. In particular, the sealing element 115, the slip assembly 120, the outer housing 140, and the guide shoe 110 can all move upward relative to the mandrel body 200 but downward movement relative to the mandrel body 200 is minimized by the friction or interference-fit interface 425 between the outer surface of the mandrel body 200 and the inner surface of the outer housing 140. Other types of directional control mechanisms known in the art can be used in addition to or as an alternative to the friction or interference-fit interface 425.

The length of the frac-plug 100 when in a set position is shorter than the length 202 of the frac-plug 100 when in an unset position as shown in FIG. 4. A pre-set gap length 435 (as shown in FIG. 5A) formed between the mandrel body 200 and the guide shoe 110 transitions to a set gap length 440 (as shown in FIG. 5B) after setting, the set gap length 440 being less than the pre-set gap length 435. In one example, the length 202 is about 13.5 inches in the unset position and shortens by about 2 inches or 2.5 inches in the set position.

This shortened length results in less time needed to drill out the frac-plug 100 to have full bore access to the casing 405 when desired, such as after the completion of a fracturing and/or stimulation operation as known in the art.

While the foregoing is directed to embodiments of the disclosure, other and further embodiments of the disclosure thus may be devised without departing from the basic scope thereof, and the scope thereof is determined by the claims that follow.

The invention claimed is:

1. A frac plug, comprising;

a mandrel body;

a cap coupled to an upper end of the mandrel body, wherein the cap has an angled surface;

an outer housing coupled to a lower end of the mandrel body;

a friction or interference-fit interface disposed between an outer surface of the mandrel body and an inner surface of the outer housing;

a guide shoe coupled to the outer housing;

a single slip assembly positioned between the cap and the guide shoe and surrounding the mandrel body; and a sealing element positioned between the cap and the single slip assembly and surrounding the mandrel body, wherein the sealing element is movable along the angled surface to force the sealing element radially outward into contact with a surrounding wellbore, and the friction or interference-fit interface is configured to allow the sealing element, the single slip assembly, the outer housing, and the guide shoe to move relative to the mandrel body in one axial direction and prevent movement in an opposite axial direction.

2. The frac plug of claim 1, wherein the single slip assembly includes a cone and a plurality of slips movable along the cone to force the slips radially outward into contact with the surrounding wellbore.

3. The frac plug of claim 1, wherein the sealing element comprises a biasing member disposed in a polymeric body.

4. The frac plug of claim 1, wherein a length of the frac plug when in a set position is shorter than the length of the frac plug when in an unset position.

5. The frac plug of claim 1, further comprising a shear cap disposed within and coupled to the guide shoe by a plurality of shear pins.

6. The frac plug of claim 1, wherein the mandrel body has a flow bore configured to allow fluid flow through the frac plug.

7. The frac plug of claim 6, wherein the mandrel body has a ball seat configured to receive a ball member to close fluid flow through the flow bore.

8. The frac plug of claim 1, wherein the upper end of the cap has a shoulder as a contact point for a setting tool.

9. A frac plug, comprising;

a mandrel body;

a cap coupled to an upper end of the mandrel body;

an outer housing coupled to a lower end of the mandrel body;

a friction or interference-fit interface disposed between an outer surface of the mandrel body and an inner surface of the outer housing;

a guide shoe coupled to the outer housing;

a single slip assembly positioned between the cap and the guide shoe and surrounding the mandrel body; and a sealing element positioned between the cap and the single slip assembly and surrounding the mandrel body, wherein a length of the frac plug when in a set position is shorter than the length of the frac plug when in an unset position, and the friction or interference-fit interface is configured to allow the sealing element, the single slip assembly, the outer housing, and the guide shoe to move relative to the mandrel body in one axial direction and prevent movement in an opposite axial direction.

10. The frac plug of claim 9, wherein the sealing element comprises a biasing member disposed in a polymeric body.

11. The frac plug of claim 9, wherein the single slip assembly includes a cone and a plurality of slips movable along the cone to force the slips radially outward into contact with a surrounding wellbore.

12. The frac plug of claim 9, wherein the cap has an angled surface, and wherein the sealing element is movable along the angled surface to force the sealing element radially outward into contact with a surrounding wellbore.

13. The frac plug of claim 9, further comprising a shear cap disposed within and coupled to the guide shoe by a plurality of shear pins.

14. The frac plug of claim 9, wherein the mandrel body has a flow bore configured to allow fluid flow through the frac plug when the frac plug is in the set position and the unset position.

15. The frac plug of claim 14, wherein the mandrel body has a ball seat configured to receive a ball member to close fluid flow through the flow bore when the frac plug is in the set position.

16. The frac plug of claim 9, wherein the upper end of the cap has a shoulder as a contact point for a setting tool.

17. A frac plug, comprising;

a mandrel body;

a cap coupled to an upper end of the mandrel body;

an outer housing coupled to a lower end of the mandrel body;

a friction or interference-fit interface disposed between an outer surface of the mandrel body and an inner surface of the outer housing;

a guide shoe coupled to the outer housing;

a slip assembly positioned between the cap and the guide shoe and surrounding the mandrel body; and a sealing element positioned between the cap and the slip assembly and surrounding the mandrel body, wherein the friction or interference-fit interface is configured to allow the sealing element, the slip assembly, the outer housing, and the guide shoe to move relative to the mandrel body in one axial direction and prevent movement in an opposite axial direction.

18. The frac plug of claim 17, wherein a length of the frac plug when in a set position is shorter than the length of the frac plug when in an unset position, wherein the length of the frac plug extends from a lower end of the guide shoe to an upper end of the cap.

19. The frac plug of claim 17, wherein the slip assembly includes a cone and a plurality of slips movable along the cone to force the slips radially outward into contact with a surrounding wellbore.

20. The frac plug of claim 17, wherein the cap has an angled surface, and wherein the sealing element is movable along the angled surface to force the sealing element radially outward into contact with a surrounding wellbore.

* * * * *